US005397524A

United States Patent [19]

Phillips

[11] Patent Number: 5,397,524

[45] Date of Patent: Mar. 14, 1995

[54] APPARATUS AND METHOD FOR MANUFACTURING CONCRETE FORM MOULDINGS

[75] Inventor: Richard M. Phillips, Austin, Tex.

[73] Assignee: Godonco Industries, Inc., Austin, Tex.

[21] Appl. No.: 135,947

[22] Filed: Oct. 12, 1993

Related U.S. Application Data

[62] Division of Ser. No. 695,965, May 6, 1991, abandoned.

[51] Int. Cl.[6] ..... B26F 3/12

[52] U.S. Cl. ..... 264/145; 264/158; 425/289; 425/308

[58] Field of Search ..... 264/41, 45.8, 45.9, 264/46.1, 145, 148, 157, 158, 159; 425/4 C, 289, 307, 308, 302.1

[56] References Cited

U.S. PATENT DOCUMENTS

| | | | |
|---|---|---|---|
| 3,028,652 | 4/1962 | Burch et al. | 264/158 |
| 3,065,500 | 11/1962 | Berner | 425/4 C |
| 3,628,937 | 12/1971 | Schott | 425/4 C |
| 3,702,180 | 11/1972 | Jones | 264/51 |
| 3,734,991 | 5/1973 | Vrijma | 264/157 |
| 3,761,209 | 9/1973 | Hanton | 425/4 C |
| 3,830,604 | 8/1974 | Korpela | 425/4 C |
| 3,844,527 | 10/1974 | Scott | 249/134 |
| 3,895,087 | 7/1975 | Ottinger et al. | 425/4 C |
| 4,116,415 | 9/1978 | Ward | 249/188 |
| 4,128,611 | 12/1978 | Kolakowski et al. | 425/4 C |
| 4,536,145 | 8/1985 | Sawyer et al. | 425/289 |
| 4,538,787 | 9/1985 | Fox et al. | 249/134 |
| 4,887,789 | 12/1989 | Harris et al. | 249/134 |
| 4,889,310 | 12/1989 | Boeshart | 249/134 |
| 5,002,817 | 3/1991 | Jones | 249/189 |
| 5,098,059 | 3/1992 | Sawyer | 249/134 |

OTHER PUBLICATIONS

Contemporary Polymer Chemistry, Allcock, H. R. et al., 1981, pp. 526–527.

*Primary Examiner*—Jay H. Woo
*Assistant Examiner*—Duane S. Smith
*Attorney, Agent, or Firm*—Shaffer & Culbertson

[57] ABSTRACT

A concrete form molding is formed of a molding body of closed cell extruded polystyrene material. The molding body includes at least one molding face comprising an extruded molding face formed in the polystyrene material extrusion process. The concrete form molding may also include one or more cut molding faces that are formed after the material is extruded. Each cut molding face is also made up of substantially all closed polystyrene cells. The apparatus of the invention includes an arrangement for precisely supporting a sheet of closed cell extruded polystyrene material vertically and horizontally with respect to a series of laterally spaced apart forming elements. The apparatus also includes structure for advancing the sheet through the forming elements so that the forming elements make contact with the polystyrene material and melt the material. The molten polystyrene material closes substantially all of the cells intersected by the forming elements to form the cut molding faces.

15 Claims, 2 Drawing Sheets

APPARATUS AND METHOD FOR MANUFACTURING CONCRETE FORM MOULDINGS

This application is a division of U.S. patent application Ser. No. 07/695,965, filed May 6, 1991, now abandoned.

BACKGROUND OF THE INVENTION

This invention relates to concrete form mouldings, and more particularly, to a concrete form mouldings formed from closed cell extruded polystyrene. The invention also encompasses an apparatus and method for manufacturing concrete form moulding strips from sheets of extruded polystyrene.

Concrete form mouldings are thin strips of material that can be built into concrete forms to give the resultant cast concrete a particular size, shape, or architectural feature. Such concrete form mouldings include chamfer, cant, rustication, reveal, drip, and cap strips.

Concrete form mouldings have commonly been made from various types of wood. Although the industry standard for years, these wooden concrete form mouldings had several drawbacks. First, the wooden moulding strips were bundled together in commercial packaging and these bundles were heavy and therefore difficult to handle and transport. Also, many types of wood were too porous and irregular for use as concrete form mouldings and the better, less permeable and more stable woods were expensive. Furthermore, wooden concrete form mouldings were expensive to machine into the required thin strips having a consistent cross-sectional shape, and even the best wooden concrete form moulding strips could warp or bow to the point of being unusable. The thin wooden concrete form moulding strips could also split as they were being attached to concrete forms.

Expanded bead polystyrene has also been used to form concrete form mouldings. Although the expanded bead polystyrene material was less expensive and overcame other problems associated with wooden concrete form mouldings, there were several problems with such concrete form mouldings which made them impractical. Perhaps the most important drawback to expanded bead polystyrene concrete form mouldings was that the material did not release easily from the moulded concrete once the concrete was set. The difficulty in releasing arose from the porosity and permeability of expanded bead polystyrene material. The material absorbed water and cement causing it to actually cement to the concrete as the concrete set. Traditional release agents could not be applied to the expanded bead polystyrene to alleviate the releasing problem because such release agents were petroleum based and dissolved the expanded polystyrene material.

Polystyrene concrete form mouldings have been manufactured from sheets or blocks of polystyrene material using hot wire cutting devices. The devices include an element known in the art as a harp having a series of a spaced-apart wires that are each as long as the length of moulding to be cut. The wires of harp are heated to a cutting temperature and then the harp is maneuvered through the sheet or block of polystyrene to cut the desired shape of moulding.

There were several problems with prior devices for forming concrete form mouldings from polystyrene or similar plastic materials. First, the machine for moving the harp relative to the plastic was very complicated and expensive. More importantly, it was difficult to maintain the proper tension in the long cutting wires required to cut the moulding strips lengthwise. When the wire loosened, it would bow as the harp moved through the plastic creating undesired curves or waves in the surfaces of the resultant moulding piece.

SUMMARY OF THE INVENTION

It is a general object of the invention to provide and apparatus and method for manufacturing an improved polystyrene concrete form moulding. The apparatus and method according to the invention, overcomes the above-mentioned problems and others associated with prior devices and methods for producing concrete form mouldings from polystyrene or the like.

A concrete form moulding according to the present invention includes a body of high density, closed cell extruded polystyrene having at least one extruded moulding face. The extruded moulding face comprises one of the surfaces formed as the polystyrene material is extruded. Since it is formed in the extrusion process, all of the polystyrene cells along the extruded moulding face are closed cells and the moulding face provides a smooth and substantially impermeable surface that releases easily from the set concrete. The closed cell extruded polystyrene foam concrete form mouldings according to the invention also do not warp or bow, are light weight, and unlike expanded bead polystyrene concrete form mouldings, are not susceptible to breaking or splitting when nailed or stapled to the concrete forms.

In some forms of the invention the concrete form moulding shape may include moulding faces that are not extruded moulding faces. In these forms of the invention the concrete form moulding includes at least one cut moulding face. The cut moulding face is formed after the polystyrene material is extruded, however, the cells that are disrupted along said face are resealed in the cutting process to form a smooth, closed cell surface that readily releases from the set concrete.

The method for producing concrete form moulding strips according to the invention comprises cutting a plurality of moulding strips from a sheet of closed-cell extruded polystyrene. This method includes supporting the sheet of extruded polystyrene material in a sheet positioning channel and also supporting a plurality of forming elements spaced out laterally along an open outlet end of the channel. The method also includes heating the plurality of forming elements and advancing the sheet of polystyrene material out the open outlet end of the channel. As the sheet is advanced, the heated forming elements contact and melt the polystyrene material to cut the advancing sheet into strips of concrete form mouldings having the desired cross-sectional shapes and including at least one extruded moulding face. The speed at which the sheet of material is advanced and the heat of the forming elements is controlled so that the cells of the sheet that are intersected by the forming elements are cut and then substantially resealed by the displaced molten polystyrene material.

In addition to the method of manufacturing concrete form moulding the invention also encompasses an apparatus for manufacturing the concrete form moulding strips from a sheet of closed cell extruded polystyrene material. The apparatus according to the invention includes channel means for supporting the sheet of material along one face and two opposing lateral edges, forming means positioned at an open outlet end of the channel, and exit support means for supporting the thin concrete form moulding strips produced by the process. The forming means comprises laterally spaced apart forming elements supported at the channel outlet end and means for heating the forming elements to desired polystyrene melting temperature. The apparatus also includes drive means for advancing the sheet out of the channel through its open outlet end so as to pass through the forming elements.

The apparatus and method for producing concrete form mouldings according to the invention has several advantages. First, the forming elements, which are preferably wires heated through electrical resistance heating, may be supported at many points along their length. This support prevents the wire from bowing substantially as the wire cuts through the polystyrene material and results in a precise planar surface. Also, moving the polystyrene workpiece relative to the forming elements greatly simplifies the apparatus.

These and other objects, advantages, and features of the invention will be apparent from the following description of the preferred embodiments, considered along with the accompanying drawings.

DESCRIPTION OF THE PREFERRED EMBODIMENTS

Figure 2:
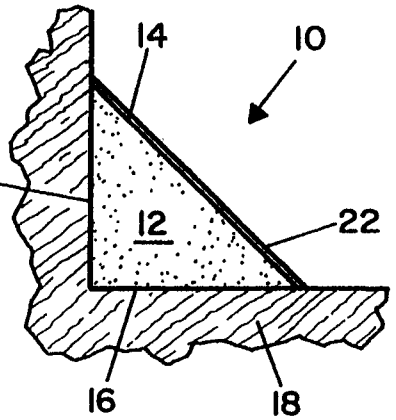
FIG. 2 is a view in transverse section of the concrete form moulding shown in FIG. 1 as it is connected to a concrete form to provide the desired forming effect.
Figure 1:
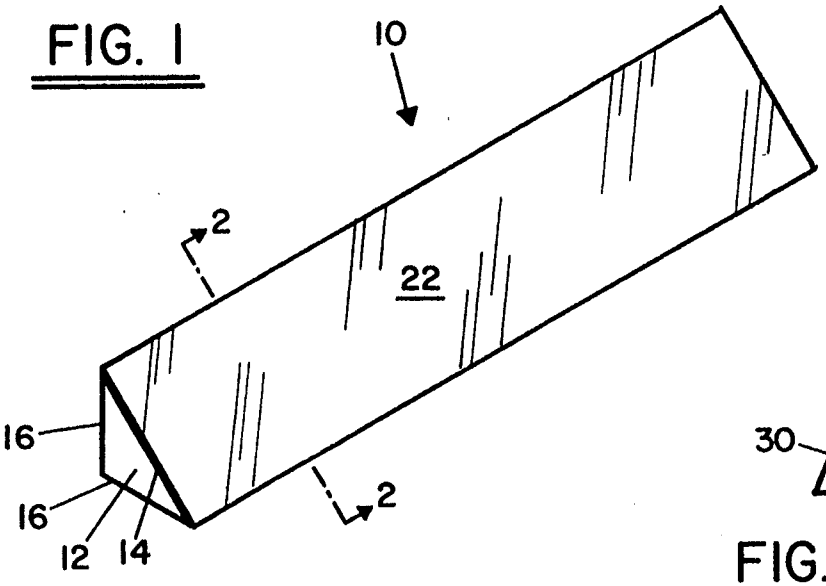
FIG. 1 is a view in perspective of a concrete form moulding chamfer strip embodying the principles of the invention.

FIGS. 1 and 2 show a concrete form moulding 10 embodying the principles of the invention. The moulding 10 includes a moulding body 12 having at least one moulding face 14 and at least one anchor face 16. As indicated in FIG. 2, the anchor face 16 is adapted to abut the surface of a concrete form 18 when the moulding body 12 is connected to the form in position to provide the desired forming effect. The moulding face 14 faces outwardly from the concrete form 18 in position to contact the concrete (not shown) cast in the form. The moulding shown in FIGS. 1 and 2 is a chamfer strip adapted to provide a beveled corner to cast concrete and having a single moulding face 14 and two anchor faces 16 that abut the corner surfaces of the concrete form 18.

The moulding body 12 according to the invention is formed from high density closed cell extruded polystyrene. In one preferred form of the invention, the moulding body 12 is formed from STYROFOAM brand extruded polystyrene produced by Dow Plastics U.S.A. The preferred material has a 2+ pound density and 25 to 30 PSI compressive strength.

At least one moulding face 14 according to the invention is an extruded moulding face. Each extruded moulding face is formed as the polystyrene material is extruded. The formation in the extrusion process insures a smooth closed cell moulding face with low permeability and good release properties. In the chamfer strip shown in FIGS. 1 and 2, the single moulding face 14 is the extruded moulding face. As shown particularly in FIG. 2, the extruded moulding face may also include a layer of release material 22 to further enhance the moulding release properties.

Figure 3:
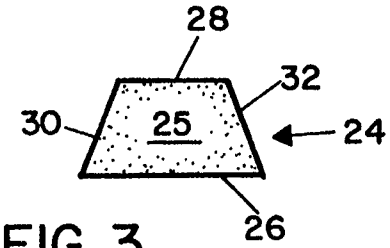
FIG. 3 is a view in transverse section of an alternate concrete form moulding strip embodying the principles of the invention.

FIG. 3 shows a rustication concrete form moulding 24 embodying the principles of the invention. The rustication moulding 24 includes a moulding body 25 having single anchor face 26 and three moulding faces 28, 30, and 32. Moulding face 28 is an extruded moulding face and the two lateral moulding faces 30 and 32 are cut moulding faces. Each cut moulding face 30 and 32 is formed after the polystyrene material that makes up the moulding body 25 is extruded. However, the faces 30 and 32 are formed so that the cells intersected and broken in the cutting process are substantially all resealed or reclosed. The cut moulding faces 30 and 32, therefore, are smooth and substantially impermeable and exhibit good release properties similar to the extruded moulding face 28, even without any release agent or film.

Figure 4:
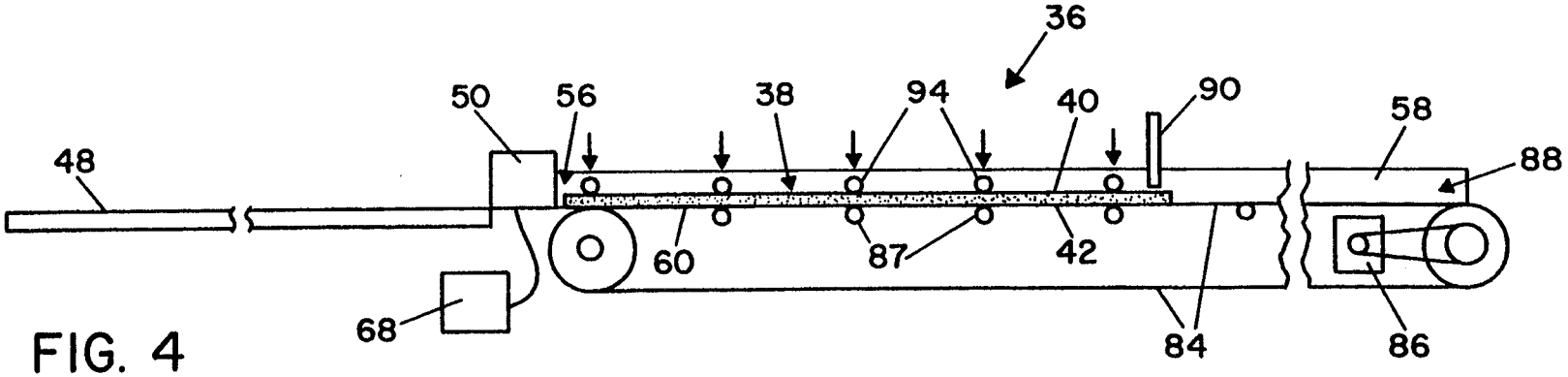
FIG. 4 is mostly schematic representation in longitudinal section of the apparatus for producing concrete form moulding strips embodying the principles of the invention.
Figure 5:
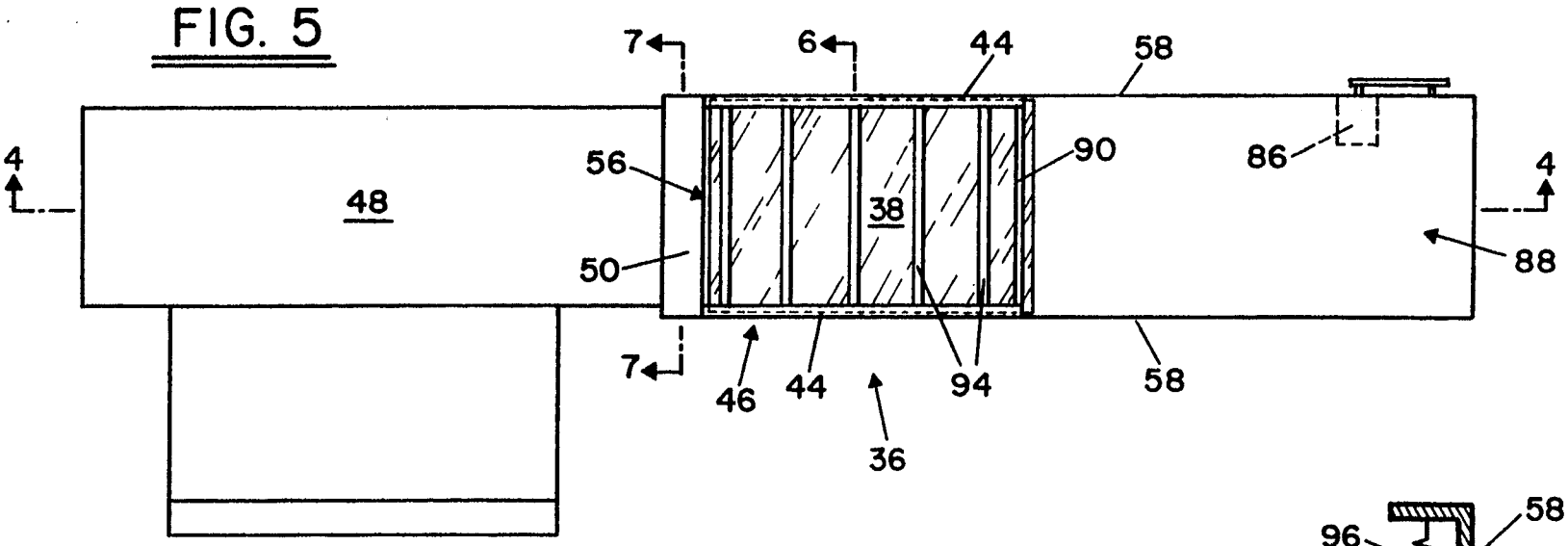
FIG. 5 is a mostly schematic plan view of the apparatus shown in FIG. 4.

The invention also includes an apparatus and method for producing concrete form moulding strips embodying the principles of the invention from a sheet of closed cell extruded polystyrene material. FIGS. 4 and 5 are mostly schematic representations of one preferred apparatus 36 for producing concrete form moulding strips. The sheet 38 of closed cell extruded polystyrene material upon which the apparatus 36 operates comprises a generally planar sheet of extruded polystyrene material similar to STYROFOAM brand extruded polystyrene, for example, having upper and lower extruded surfaces 40 and 42, respectively, and parallel opposing lateral edges 44.

As shown in FIGS. 4 and 5, the apparatus 36 includes sheet positioning channel means 46, exit support means 48, forming means 50, and sheet drive means 52. The channel means 41 is adapted to support the sheet 38 of polystyrene material in a precise vertical and horizontal position relative to the forming means 50 and the drive means 52 is adapted to drive the sheet to the left in FIGS. 4 and 5 through the forming means to form a plurality of concrete form moulding strips having the desired transverse cross-sectional shape comprising cut moulding faces and extruded moulding faces. The exit support means 48 supports the thinly cut polystyrene material after it passes the forming means 50 while the remaining portion of the sheet 38 is advanced and cut.

The channel means 46 includes an open outlet end 56, two parallel channel sides 58 and channel bottom support 60. The two channel sides 58 are adapted to abut the lateral sheet edges 44 when the sheet 38 is received in the channel to provide precise lateral positioning relative to the cutting means 50. The channel bottom support 60 supports the lower extruded surface 42 of the sheet along a channel plane to provide precise vertical positioning of the sheet 38 relative to the forming means 50. The exit support means 48 comprises a smooth-surfaced table extending generally in the channel plane on the side of the forming means 50 opposite the channel 46.

Figure 7:
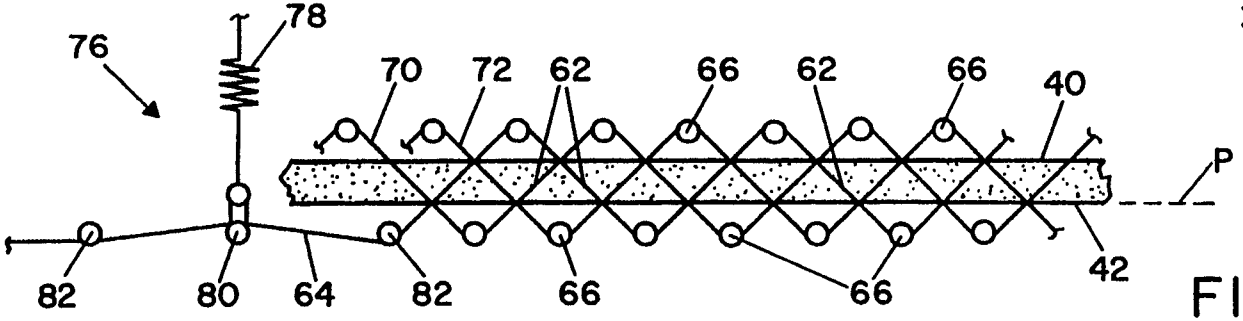
FIG. 7 is schematic representation of the forming means embodying the principles of the invention as viewed from line 7—7 in FIG. 5.

Referring to FIG. 7, the forming means 50 comprises a plurality of forming elements 62 laterally spaced apart along the open channel outlet end 56, and means for continuously heating the forming elements to a polystyrene material melting temperature. The adjacent laterally spaced forming elements 62 are positioned or supported to form forming lines traversing the channel plane (P in FIG. 7) and a distance above the channel plane P corresponding to at least the thickness of the sheet 38. These adjacent forming lines combine with the planes of the upper and lower extruded surfaces 40 and 42, respectively, of the sheet 38 to provide a desired moulding cross-sectional shape.

The preferred forming elements 62 are formed from at least one electrically resistive cutting member 64 such as a suitable wire arranged and supported by a series of electrically insulated support elements 66 to form the desired forming lines. The heating means comprises means 68 (FIG. 4) for directing an electrical current through the resistive wire to heat the wire or other member to the desired polystyrene melting temperature. As shown in FIG. 7, the preferred embodiment of the invention for producing chamfer strip mouldings such as the moulding shown in FIGS. 1 and 2 includes three separate cutting members 64, 70, and 72, each element member being strung over and supported by a different set of support elements 66. The members 64, 70, and 72 are also spaced apart slightly along the line of view shown at line 7—7 in FIG. 5 to produce the desired forming line pattern.

The tension of the cutting members 64, 70, and 72 must be controlled to produce the desired forming lines. However, the heating and cooling of each member produces substantial changes in the member length and this change in length affects the tension of the member. In order to maintain a desired tension in the cutting members 64, 70, and 72 in spite of the length changes due to heating and cooling, the invention also includes forming member tensioning means 76 shown in FIG. 7. The tensioning means 76 comprises a member tensioning spring 78 connected by a support link 80 to the cutting member 64 to provide a desired tensioning force at a point between two electrically insulating tensioning supports 82. Each of the three cutting members 64, 70, and 72 has a similar tensioning arrangement although the tensioning means for members 70 and 72 are omitted from FIG. 7.

The drive means 52 includes an endless conveyor belt 84 having an upper flight forming the channel bottom support 60 and a suitable drive motor 86 for driving the belt so that its upper flight moves to the left in FIGS. 4 and 5. The conveyor belt 84 is supported by suitable rollers 87 along its length to maintain the belt in the desired channel plane. Preferably the upper flight of the belt 84 is long enough to accommodate two of the sheets 38 end to end, with the end of the belt opposite the channel outlet end 56 comprising a sheet feed area 88. A plurality of the sheets may be stacked in the sheet feed area 88 and a feed bar 90 is positioned to allow only one sheet to pass toward the forming means 50 at one time.

Figure 6:
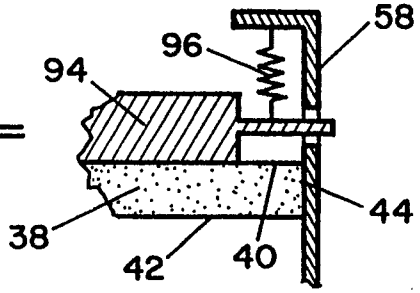
FIG. 6 is a mostly schematic representation of the sheet positioning means embodying the principles of the invention.

The illustrated preferred form of the invention also includes sheet positioning means 92. The sheet positioning means 92 presses the advancing sheet against the conveyor belt to hold the lower extruded surface 42 of the sheet 38 generally in the channel plane and prevent slippage between the belt surface and the sheet. Such slippage must be eliminated in order to provide the desired feed rate at which the sheet 38 is fed through the forming means 50. As shown in FIGS. 4, 5, and 6, the sheet positioning means 92 includes a plurality of idler rollers 94 longitudinally spaced along the length of the conveyor belt 84 near the channel outlet end 56. As shown best in FIG. 6, each roller 94 is connected at each end to the parallel channel sides 58 and is biased downwardly by an idler roller biasing spring 96. The biasing springs 96 at each end of the roller 94 along with the weight of the idler roller itself provides the downward positioning force required to prevent slippage between the lower extruded surface 42 of the sheet 38 and the conveyor belt 84.

In the operation of the apparatus 36 and according to the method of the invention, the sheet 38 of closed cell extruded polystyrene material is supported in the channel 46 with the lower sheet surface 42 lying in the channel plane defined by the channel bottom support 60. The channel sides 58 abut the lateral sheet edges 44 for precise lateral positioning of the sheet 38. The method also includes supporting the plurality of forming elements 62 at laterally spaced apart positions along the channel outlet end 56 to form the series of adjacent forming lines shown in FIG. 7. The adjacent forming lines formed by the elements 62 combine with the upper and lower extruded surfaces 40 and 42, respectively, of the sheet 38 positioned by the channel 46 to form the desired moulding cross-sectional shape such as the triangular chamfer strip cross section shown in FIG. 7. With the forming elements 62 and the sheet 38 properly supported, the method also includes continuously heating the forming elements 62 to a polystyrene melting temperature and advancing the sheet past the forming elements. As the sheet 38 of polystyrene material is advanced the forming elements 62 melt the material along the forming lines to cut the sheet into the moulding strips. The molten polystyrene material closes substantially all of the cells that are intersected and broken by the forming elements to form the cut moulding faces described above with reference to FIG. 1-3.

The tensioning arrangements such as tensioning means 76, serve to keep the desired tension on the forming elements, preferably electrically resistive wires, throughout the polystyrene cutting process. The preferred wires comprising the forming elements 62 expand and increase in length particularly as they are brought up from ambient temperature to the desired plastic cutting temperature. The tension means 76 with its tensioning spring 78 enables the slack to be taken out of the wire element 62 as its length increases over the support elements 66, thereby maintaining a desired tension in the wire along its entire length.

The method also includes applying a downward positioning force to the sheet 38 in the channel 46. The preferred downward positioning force is provided by a series of longitudinally spaced idler rollers 94 biased downwardly by springs 96 at each end thereof. The downward force on the sheet 38 forces the lower sheet surface 42 into driving contact with the upper flight of the conveyor belt 84 to prevent slippage between the sheet and the belt.

The above described preferred embodiments are intended to illustrate the principles of the invention, but not to limit the scope of the invention. Various other embodiments and modifications to these preferred embodiments may be made by those skilled in the art without departing from the scope of the following claims.

I claim:

1. A method of manufacturing a concrete form moulding from a sheet of closed cell extruded polystyrene material having two parallel lateral sheet edges and generally planar and parallel upper and lower extruded surfaces, the method comprising the steps of:

(a) supporting the sheet of closed cell extruded polystyrene material in a sheet positioning channel having an open outlet end, parallel channel sides, and a channel bottom support, the parallel lateral edges of the extruded polystyrene sheet substantially abutting the channel sides when the sheet is supported in the sheet positioning channel;

(b) supporting a plurality of laterally spaced apart electrically resistive heated cutting wires at the outlet end of the sheet positioning channel with each cutting wire in position to traverse a channel plane defined by the channel bottom support and a distance above the channel plane equal to the thickness of the concrete form moulding to be created so as to form an individual forming line that combines with the forming line formed by an adjacent cutting wire and the planes of the upper and lower extruded surfaces of the extruded polystyrene sheet to provide a desired moulding cross-sectional shape;

(c) continuously heating the cutting wires to a temperature sufficient to melt the polystyrene material from which the sheet is formed upon contact with said material; and (d) advancing the sheet of polystyrene material out of the sheet positioning channel through the outlet end thereof and through the cutting wires so that the cutting wires cut the polystyrene material.

2. The method of claim 1 including the step of:

(a) applying a downward positioning force to the upper extruded surface of the polystyrene sheet received in the channel as the sheet is advanced out of the sheet positioning channel.

3. The method of claim 2 wherein:

(a) the downward positioning force is applied by a plurality of longitudinally spaced apart rollers connected to the channel sides, each roller being biased toward the channel bottom support in position to contact the upper extruded surface of the polystyrene sheet supported in the channel.

4. The method of claim 2 wherein the channel bottom support comprises an upper flight of an endless conveyor belt supported by conveyor belt support means and further comprising the step of:

(a) driving the endless conveyor belt so that its upper flight moves toward the outlet end of the channel.

5. The method of claim 1 wherein the cutting wires are comprised of a continuous wire of electrically resistive material and the step of supporting the cutting wires comprises:

(a) supporting the continuous wire over a plurality of support elements positioned on a lower side of the channel plane and on an upper side of the upper extruded surface of the sheet of polystyrene material supported in the sheet positioning channel.

6. The method of claim 5 including the step of:

(a) continuously applying a tensioning force to the continuous wire.

7. An apparatus for manufacturing concrete form moulding from a sheet of closed cell extruded polystyrene material having substantially parallel lateral edges and generally planar and parallel upper and lower extruded surfaces, the apparatus comprising:

(a) channel means for supporting the sheet of polystyrene material so that the sheet lower extruded surface lies generally in a channel plane, the channel means including an open outlet end, a channel bottom support defining the channel plane, and channel sides, the channel sides adapted to substantially abut the parallel lateral edges of the sheet when the sheet is supported by the channel means;

(b) drive means for advancing the sheet supported by the channel means out of the channel outlet end;

(c) a plurality of electrically resistive heated cutting wires positioned at the outlet end of the channel means for melting the polystyrene material forming the sheet along a plurality of laterally spaced apart forming lines as the sheet is advanced by the drive means, each forming line positioned so as to traverse the channel plane and a distance above the channel plane equal to a thickness of the concrete form moulding to be created, and adjacent laterally spaced apart forming lines intersecting with the planes of the upper and lower extruded surfaces of the sheet to form a desired moulding cross-sectional shape; and (d) exit support means positioned on the opposite side of the cutting wires from the channel means for receiving and supporting moulding strips formed from the polystyrene sheet as the sheet is advanced out of the channel through the channel outlet end and is cut by the cutting wires.

8. The apparatus of claim 7 wherein:

(a) the channel bottom support comprises the upper flight of an endless conveyor belt; and (b) the drive means includes means for driving the endless conveyor belt.

9. The apparatus of claim 8 further comprising:

(a) sheet positioning means positioned above the channel bottom support for retaining the lower extruded surface of the sheet in driving contact with the conveyor belt so that the belt may continuously advance the sheet through the forming means.

10. The apparatus of claim 9 wherein the positioning means comprises:

(a) a plurality of idler rollers longitudinally spaced apart along the channel means, each idler roller being connected to the channel means so as to extend transversely across the channel means between the channel sides.

11. The apparatus of claim 10 further comprising:

(a) biasing means connected to each idler roller for biasing said idler roller toward the conveyor belt.

12. The apparatus of claim 7 wherein the cutting wires includes:

(a) a continuous wire made of an electrically resistive material;

(b) a plurality of support members positioned on a lower side of the channel plane and on an upper side of the upper extruded surface of the sheet of polystyrene material, the continuous wire strung over such support members so that it forms the forming lines extending between the support members; and (c) means for directing an electrical current through the continuous wire so as to continuously heat the continuous wire to a temperature sufficient to melt the polystyrene material of the sheet when the cutting wire comes in contact with said material.

13. The apparatus of claim 12 further comprising:

(a) tensioning means connected to the continuous wire for applying a tensioning force to take up any slack in the continuous wire.

14. The apparatus of claim 7 further comprising:

(a) support means for supporting the plurality of cutting wires, so as the cutting wires extend along each of the forming lines; and (b) means for directing an electrical current through each cutting wire so as to continuously heat each cutting wire to a temperature sufficient to melt the polystyrene material of the sheet.

15. The apparatus of claim 12 further comprising:

(a) tensioning means for continuously applying a tensioning force to the continuous wire.

* * * * *